175-48
2/17/81 OR 4,250,974

United States Patent [19]

Heilhecker et al.

[11] 4,250,974

[45] Feb. 17, 1981

[54] APPARATUS AND METHOD FOR DETECTING ABNORMAL DRILLING CONDITIONS

[75] Inventors: Joe K. Heilhecker; Leon H. Robinson, Jr.; Beldon A. Peters, all of Houston, Tex.

[73] Assignee: Exxon Production Research Company, Houston, Tex.

[21] Appl. No.: 945,286

[22] Filed: Sep. 25, 1978

[51] Int. Cl.[3] ..... E21B 21/08

[52] U.S. Cl. ..... 175/48; 73/155; 175/206

[58] Field of Search ..... 175/25, 38, 48, 66, 175/206; 73/155

[56] References Cited

U.S. PATENT DOCUMENTS

| | | | |
|---|---|---|---|
| 2,290,408 | 7/1942 | Crites | 175/48 |
| 2,340,993 | 2/1944 | Smith | 175/48 X |
| 2,886,287 | 5/1959 | Croley | 175/206 |
| 2,941,783 | 6/1960 | Stinson | 175/206 |
| 2,966,059 | 12/1960 | Dower | 175/48 X |
| 3,608,653 | 9/1971 | Rehm | 175/38 X |
| 3,726,136 | 4/1973 | McKean et al. | 175/48 |
| 3,740,739 | 6/1973 | Griffin et al. | 175/48 |
| 3,774,702 | 11/1973 | Elenburg | 175/66 |
| 4,031,751 | 6/1977 | Haddad | 73/155 |

*Primary Examiner*—Leppink James A.
*Assistant Examiner*—Richard E. Favreau
*Attorney, Agent, or Firm*—Robert L. Graham

[57] ABSTRACT

Abnormal drilling conditions are detected by monitoring mud volume of the mud system or rate of change of the mud volume. In one embodiment, makeup mud is automatically added to the system as solids are removed from the mud. Abnormal conditions are indicated by when the rate of makeup mud addition differs from the rate of solids removal. The mud system is maintained at a substantially constant volume by means of tanks specially constructed to provide a small mud/air interface.

23 Claims, 6 Drawing Figures

APPARATUS AND METHOD FOR DETECTING ABNORMAL DRILLING CONDITIONS

BACKGROUND OF THE INVENTION

1. Field of the Invention

The present invention relates to apparatus and method for the detection of abnormal conditions in well drilling operations by monitoring the drilling mud used in the drilling operations. The invention also relates to a novel system of handling the mud in carrying out the drilling operations.

2. Description of the Prior Art

In drilling a well by rotary drilling operations, a drilling fluid frequently called a "mud" is pumped down the drill string through the bit and back to the surface through the well annulus. The mud provides several important functions including maintaining a hydrostatic head of pressure, cooling the bit, and removing drilled particles.

In the drilling of wells, it is important to closely monitor drilling operations to detect any abnormal drilling condition that might be encountered. Under normal drilling and circulation conditions, formation fluid will not enter the well and mud will not be lost to the formation. The volume of the mud system will thus remain substantially constant. (It is recognized that a small amount of fluid will be lost through normal filtration, evaporation, and leakage. For purposes of monitoring a mud system, however, the volumes resulting from these losses may be ignored.)

An abnormal drilling or circulation condition generally results in a change in the mud volume. A particularly hazardous abnormal condition occurs when a high pressure zone is encountered. If the mud in the well does not provide a sufficient hydrostatic pressure in this zone, formation fluids will enter the well and could result in a blowout. The entry of gas is manifested by the forcing of an equivalent amount of drilling mud from the wellbore into the surface mud tanks or pits. This condition is referred to as a "kick". The initial entry may cause only a slight change in the volume of mud in the tanks; however, as the gas rises it increases its volume as the pressure of the column of mud is reduced forcing more mud out of the wellbore and allowing the entry of more gas into the bore until a blowout occurs.

When a kick is encountered, the control of a well is best maintained by acting early. However, prior art detection techniques which rely on changes in pit mud level frequently do not permit early detection of a kick. The accuracy with which the mud level can be measured is a function of the sensitivity of the fluid level detection method. For example, in a conventional system of four 8 ft by 40 ft tanks, a 9.5 barrel change in the tanks results in only a 0.5 inch change in the mud level.

Another hazardous drilling condition that must be closely monitored is that of lost circulation. If the hydrostatic pressure imposed by the mud on a subterranean formation is too great, the formation may be fractured causing mud to be lost to the formation. This, as in the blowout condition, is generally indicated by change in mud pit level.

A conventional mud volume totalizer marketed by Martin Decker Company is shown on page 4510 of the *Composite Category of Oil Field Equipment and Services*, Volume 3, 1978–79, published by World Oil. Other mud level detection devices are disclosed in U.S. Pat. Nos. 3,086,397 and 3,608,653. As mentioned previously, these devices are used in conventional systems and are not sensitive enough to provide early and reliable detection of abnormal conditions.

SUMMARY OF THE INVENTION

The present invention provides a system for detecting abnormal mud circulation (i.e., increase or decrease in fluid volume) during drilling of a well by accurately monitoring the volume of the mud system. The invention also contemplates monitoring the rate of change of volume of the mud system.

In order to fully appreciate the present invention, it is necessary to understand rotary drilling operations. A rotating drill penetrates the earth formations by forming particles, referred to as drilled solids, which are carried to the surface in the mud. At the surface the mud is treated with screening and centrifuging devices to remove drilled solids. The removal of solids by these devices inherently involves the removal of some mud. Under normal drilling conditions, the volume of the mud system (including drilled solids suspended therein) remains substantially constant. However, the continuous removal of the drilled solids reduces the volume of mud at the surface by an amount equal to the volume of material (i.e., drilled solids and mud) removed.

In a preferred embodiment of the present invention, the volume of the mud system is maintained substantially constant by adding makeup mud to the system at substantially the same rate as material removed. By closely monitoring the system, any rate change or volume change of the mud system can be detected.

The present invention contemplates monitoring the mud volume in relation to the material removed from the system. A reduction of the mud volume equal to the volume of material removed indicates normal drilling and circulation conditions. On the other hand, a change in the mud volume which does not correspond to removed material indicates an abnormal drilling condition; that is, a condition downhole is adding to or taking away from the mud system. For example, a kick (i.e., intrusion of gas) will cause the mud volume at the surface to increase. If the gas intrusion is small, the effect on the total mud volume may not be noticeable since the material discarded will to a certain extent mask any volume increase caused by the gas. However, by monitoring the rate of change of the mud volume under a given set of drilling and mud treating conditions, early detection of an abnormal condition is possible. Under the given set of conditions, solids along with a small amount of mud (i.e., from the desilters or desanders) will be discarded at about a constant rate. This rate will be equal to the continuous reduction of the mud volume. This "normal" rate can be determined by several techniques, two of which are described below. If the rate changes, as for example by the intrusion of gas or loss of mud to a formation, the rate of volumetric change of the mud system will depart from the normal rate indicating the presence of an external source or outlet of fluid. A rate less than the normal mud reduction rate indicates fluid is entering the system; on the other hand, a rate change greater than material removal indicates mud is being lost to a formation.

Monitoring the rate reduction of the mud system provides a sensitive and early means for detecting a "kick" even though the total mud volume continues to decrease. This would occur when the volume of gas intrusion is less than the volume of material discarded. A more positive indication is provided when the total mud volume increases. The present invention permits early detection of mud volume increase.

The detection system includes a tank facility having a substantially constant volume and means for detecting an increase in volume if mud volume increase exceeds the volume of materials removed by a predetermined amount. Likewise the detection system may be employed to detect "lost circulation" by providing means for detecting a decrease in mud volume below that of material removed by a predetermined amount.

Two embodiments are disclosed for achieving the early detection described above. The preferred embodiment employs a monitoring tank provided with means for adding makeup mud to the system about equal to the volume of material discarded to maintain a constant mud volume. Means are also provided for detecting when the rate of makeup mud differs from rate of material discarded or when the mud volume increase caused by the abnormal condition exceeds the volume of material discarded.

In another embodiment, the system employs two monitoring tanks connected in parallel. The mud is circulated through one tank at a time wherein the volumetric reduction of the mud system is monitored by measuring the level within the monitoring tank. Note that under normal circulation conditions the reduction of the level within the active monitoring tank will be a function of materials (i.e., drilled solids and mud) discarded from the mud system. When the volume of material removed equals the working volume of the active tank, the second monitoring tank full of makeup mud replaces the first tank and thus adds mud to the system equal to the material removed during operation of the first tank. Abnormal drilling is detected by observing the performance curve of the mud level in each tank. If the curve departs from the normal curve for a given set of normal conditions, external influences are present. A leveling off of the curve strongly indicates a "kick". An increase in the curve indicates the influx of fluid at a rate in excess of that of material removal.

A feature embodied in the present invention is the provision of a substantially constant mud volume in the surface tanks. This is achieved by providing a plurality of tanks with riser portions of reduced areal cross section. The riser portions will reduce the mud/air interface to less than 1000 square inches. With the mud level maintained in the riser section of each tank, small increases in volume will provide the necessary operating levels to achieve the desired flow between tanks and yet maintain a substantially constant total system volume.

DETAILED DESCRIPTION OF THE INVENTION AND PREFERRED EMBODIMENTS

Figure 1:
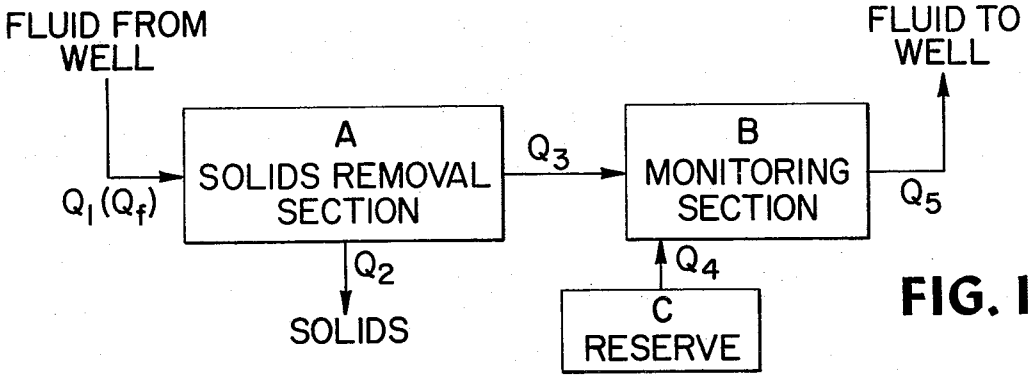
FIG. 1 is a flow diagram of a drilling fluid system according to the present invention.

FIG. 1 is a flow diagram showing generally the circulation of mud from the well (not shown) through a solids removal section A, through monitoring section B, and back into the well. In the monitoring section, makeup mud from the mud reserve C is added to the system to maintain a substantially constant volume.

In normal drilling operations the solids (and some mud associated therewith) are continuously removed in the A section. Under a given set of drilling and mud treating conditions, the solids removal in section A will be at about constant rate, and the mud volume in sections A and B will be continuously reduced by an amount equal to the volume of material discarded. Since the solids will be discarded at about a constant rate, the mud volume will be decreased at the same rate.

When the circulation conditions become abnormal (i.e., resulting from either a loss of mud into the formation or an influx of fluid from the formation into the mud) the volume change of the mud system as detected by the monitoring section B will no longer equal the volume of material discarded. This will be reflected by a departure from the "normal" rate reduction. A reduced rate provides an indication of a "kick" and an increased rate provides an indication of lost circulation. Also, the total mud volume may be monitored such that a predetermined volume increase or decrease of the volume of the mud system will result in the activation of an alarm system to alert operating personnel. As noted above, it is any variation in the constant rate of change of the mud volume as well as a net increase or decrease in the mud volume which is the indicator of the potential problem.

The invention perhaps can best be understood by considering volumetric balance of fluid flow in the flow diagram (FIG.1) in which:

$Q_1$ is the flow rate of mud from the well.

$Q_2$ is the rate of material removal from the mud.

$Q_3$ is the rate of mud entering the monitoring section.

$Q_4$ is the rate of makeup mud addition.

$Q_5$ is the rate of mud returned to the well.

Under normal drilling and circulation conditions $Q_4=Q_2$. Thus the mud volume remains constant; that is, $Q_5=Q_1$.

In the case of a kick, a rate increase ($Q_f$) of the mud flowing from the well occurs. Under these conditions:

$$Q_f+Q_l=Q_2+Q_3$$

$$Q_4=Q_2-Q_f$$

The volume of the mud system is no longer constant; the volume increase is equal to $Q_f$.

If $Q_f>Q_2$, then the volume of the mud system increases; if $Q_2>Q_f$, the mud volume remains constant but the rate of mud addition ($Q_4$) decreases indicating the abnormal condition.

Figure 2:
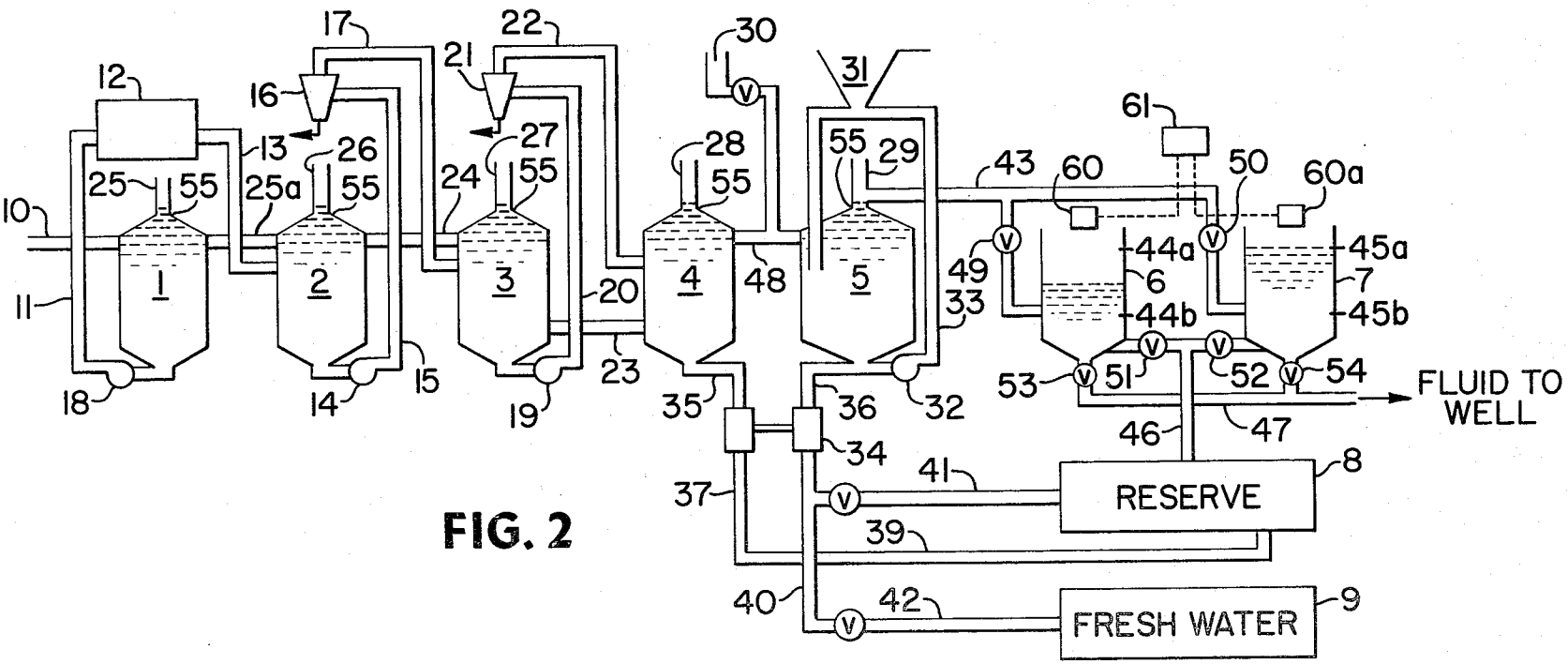
FIG. 2 is a schematic representation of a subcombination of solids removal section with a monitoring section.
Figure 3:
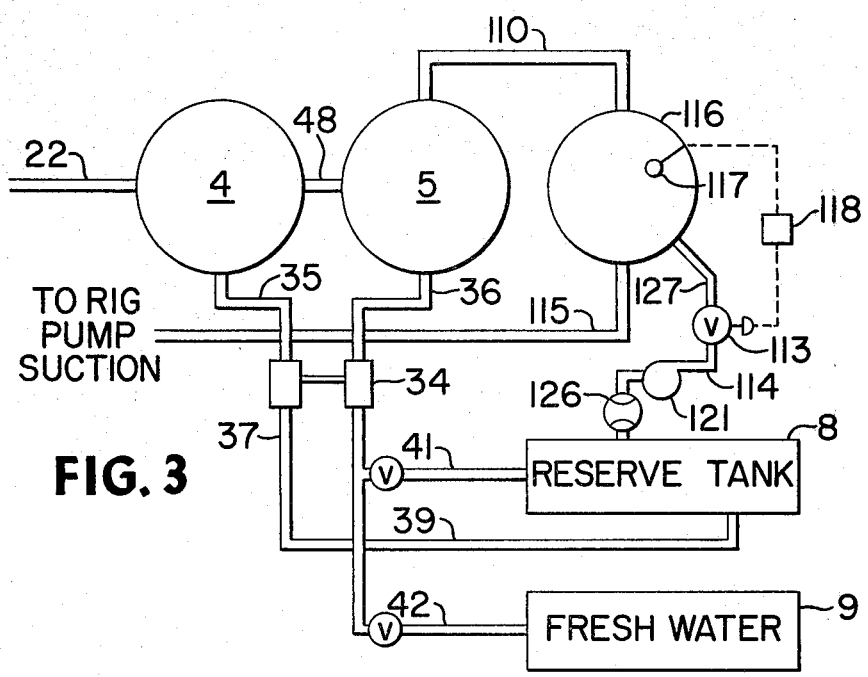
FIG. 3 is a schematic top view of another monitoring section.
Figure 4:
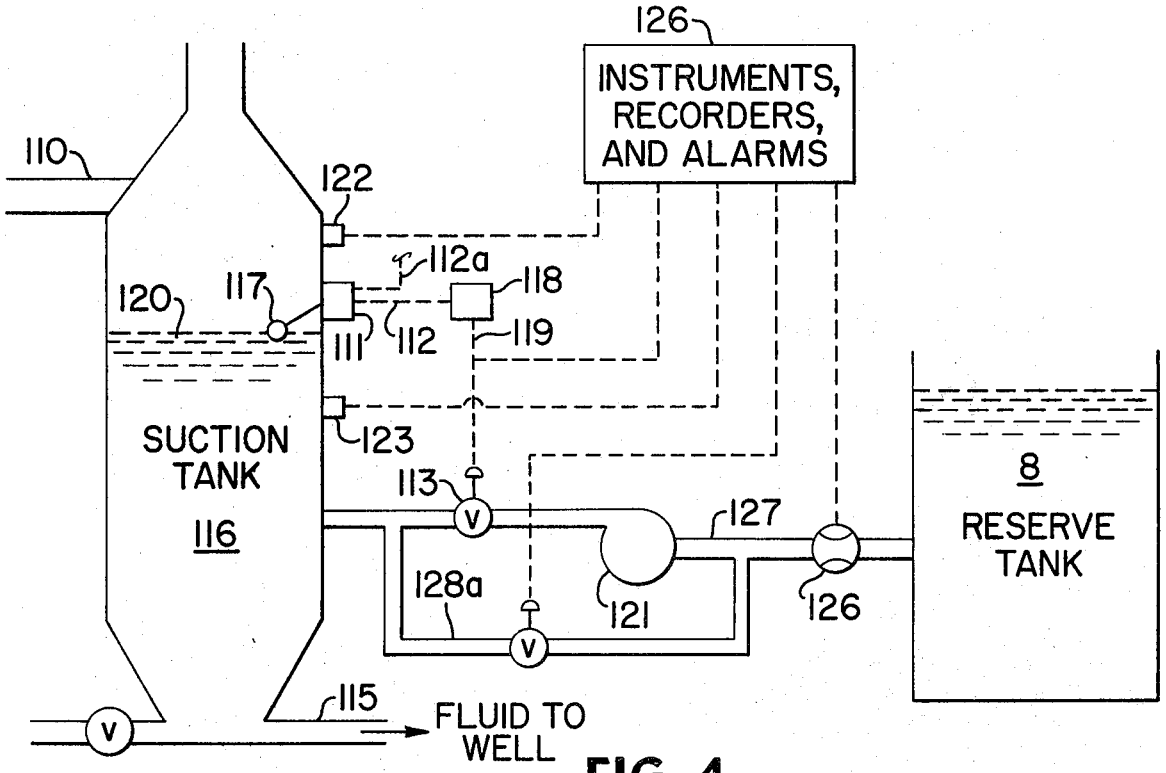
FIG. 4 is a schematic side elevation of the monitoring section shown in FIG. 3.

An important objective of the present invention is to detect a condition wherein $Q_4 \neq Q_2$ which may be achieved by use of a mud monitoring section. Two embodiments of monitoring sections are described: FIG. 2 illustrates an embodiment in which alternating monitoring tanks are employed; FIGS. 3 and 4 illustrate the preferred embodiment in which a single monitoring tank is employed.

In the embodiment illustrated in FIG. 2, mud passes from the well (not shown) into the solids removal section which includes a shale shaker (not shown), a plurality of tanks 1–5, and may include other treating equipment such as a degasser 12, a mud cleaner (not shown), desander 16, and desilter 21. As shown, the mud enters tank 1 through line 10 and is pumped through line 11 by pump 18 into degasser 12.

From the degasser 12, the degassed mud gravitates through line 13 into tank 2. Pump 14 operates to pass the mud tank 2 via line 15 to desander 16 where the underflow mud and solids are discarded and the overflow is passed to tank 3 through line 17. Pump 14 is normally operated at a higher rate than the flow coming into tank 2 via line 13, thereby causing a back flow via equalizer line 24 from tank 3 into tank 2. Mud is pumped from tank 3 by pump 19 via line 20 to desilter 21 where the underflow mud and solids are discarded and the overflow is passed through line 22 to tank 4. Pump 19 is operated at a higher rate than the feed coming into tank 3 via line 17 thereby causing a net flow through line 23 from tank 4 into tank 3. The entry of mud into tanks 2, 3 and 4 may be tangential to maintain a turbulent condition in the tanks.

Mud from tank 4 to tank 5 is through overflow line 48. A chemical barrel 30 may be attached or associated with line 48 so that chemicals or additives may be added to the system. Tank 5 may be provided with pump 32 which circulates the fluid therein through line 33 wherein a mud hopper 31 is provided for the addition of argillaceous material (e.g., bentonite) to the system as needed. The feed from tank 5 to the monitoring section B is by overflow via line 43 which is valved to allow entry into either suction tank 6 or suction tank 7.

Means are provided to permit replacement of a portion of the mud or dilution of the mud. Tanks 4 and 5 are connected to a double ended pump 34 via lines 35 and 36, respectively. The pump 34 operates so that for each stroke approximately equal volumes of two different fluids are pumped. In this fashion, fluid may be removed from tank 4 via valve line 35 through line 37 and discarded or passed via line 39 into reserve tank 8. At the same time, an equal amount of water, drilling fluid or a mixture thereof is pumped via valved lines 42, 40 and 36 into tank 5.

The tanks 1–5 are specially configurated to permit the maintenance of a substantially constant mud volume. The tanks may be circular or polygonal in cross section and preferably should be sufficient in size and number to contain at least 80 barrels of mud.

As illustrated in FIG. 2, each tank 1–5 has a conical top section which supports standpipe or riser portions 25, 26, 27, 28, and 29, respectively. The riser portions may be open to the atmosphere as illustrated. The riser portions are preferably between about 6 and 18 inches in diameter and thus provide a reduced areal cross section. The tanks 1–5 are placed at about the same elevation and operations are carried to maintain the mud level within the riser portions of each tank. The total area of the mud/air interface in the tanks should be less than about 1000 square inches. Thus, minor variation in hydrostatic heads between the tanks may be maintained and still provide the overall system with substantially the same volume. Note that the location of overflow line 43 determines the mud level in the embodiment illustrated in FIG. 2. The volume of the mud within the solids removal section should be maintained within 2 barrels and preferably within 1 barrel of a predetermined level. Equalizer lines 25*a*, 24, 23, and 48 provide fluid communication between the tanks.

In operation of the monitoring section as illustrated by this embodiment, only one of the monitoring tanks 6 or 7 are active at any given time. For example, if valve 49 is open, valve 50 is closed and the flow of mud from tank 5 through line 43 passes into tank 6. Valve 53 is also open and valve 54 is closed, hence the flow is through tank 6. Prior to the opening of the valves 49 and 53, tank 6 had been filled with makeup mud from reserve tank 8 (as will hereinafter be described in regard to tank 7) to top control level 44*a*. Since material is being removed from the mud, there is a net loss from the total volume of the mud system. Thus, without the addition of makeup mud to tank 6, the level in tank 6 will drop under normal drilling conditions at a rate corresponding to the rate of removal of the material from the mud. As noted above, this rate of removal of drilled solids is substantially constant for a given set of drilling and mud treating conditions when no abnormal circulation condition is present. When the level of fluid in tank 6 drops to lower level 44*b*, valves 49 and 53 are closed and valve 51 is open so that tank 6 may be filled from reserve tank 8 until the fluid level arrives at controlled upper level 44*a* at which time valve 51 is closed. This filling operation from reserve tank 8 carried out before tank 7 has been emptied so that a suction tank will be available to feed into line 47.

Conventional liquid level controls 60 and 60*a* may be employed to operate valves 49–54 at the upper and lower levels 44*a* and 44*b* within tanks 6 and 7. The same control devices may be employed to send a signal indicative of fluid level within each tank to recorder 61. When the fluid level in tank 6 reaches the lower limit 44*b*, valves 49 and 53 close; simultaneously therewith, valves 50 and 54 in tank 7 open.

As described in regard to tank 6, tank 7 is filled from reserve tank 8 via line 46 and through open valve 52 to the upper level 45*a*. When tank 7 becomes the active monitoring tank, the observation of the rate of change of the fluid level in the tank is made in the same manner as it was previously in tank 6. When the fluid level arrives at the lower level 45*b*, valves 50 and 54 close and valves 49 and 53 open thereby repeating the cycle. Similarly, valve 52 is open into tank 7 to refill tank 7 to upper limit switch 45*a* from the reserve tank 8.

Figure 5:
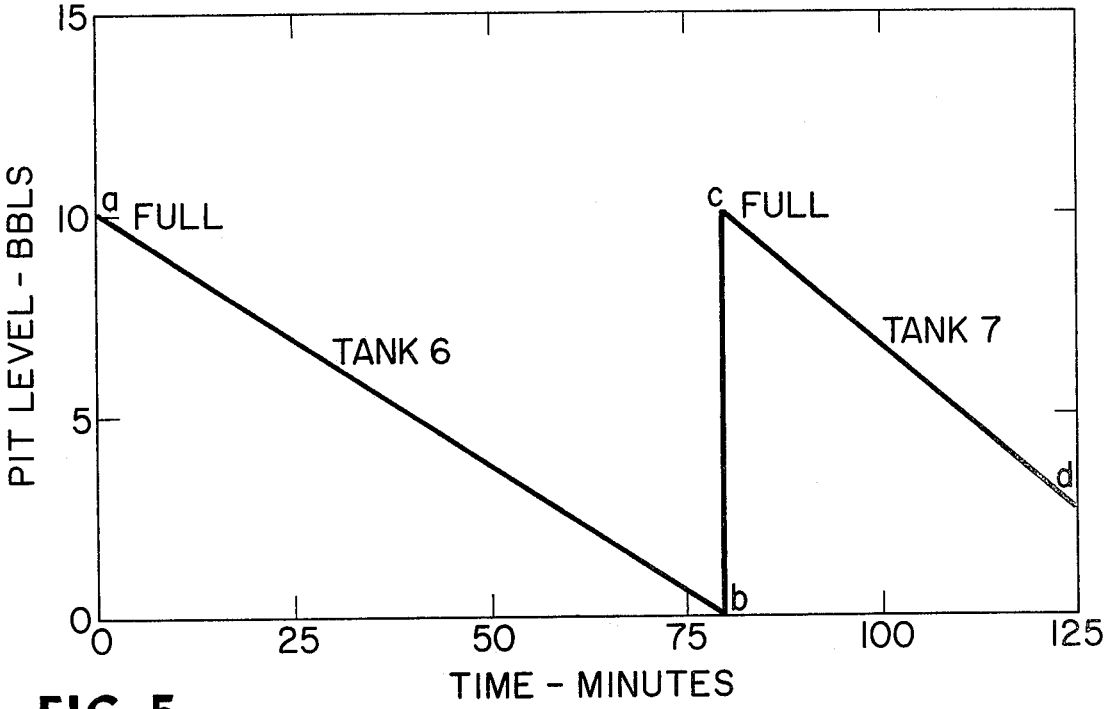
FIG. 5 is a graph plotting the rate of monitoring tank level drop versus time for a monitoring section as shown in FIG. 2 illustrating performance under normal circulation.
Figure 6:
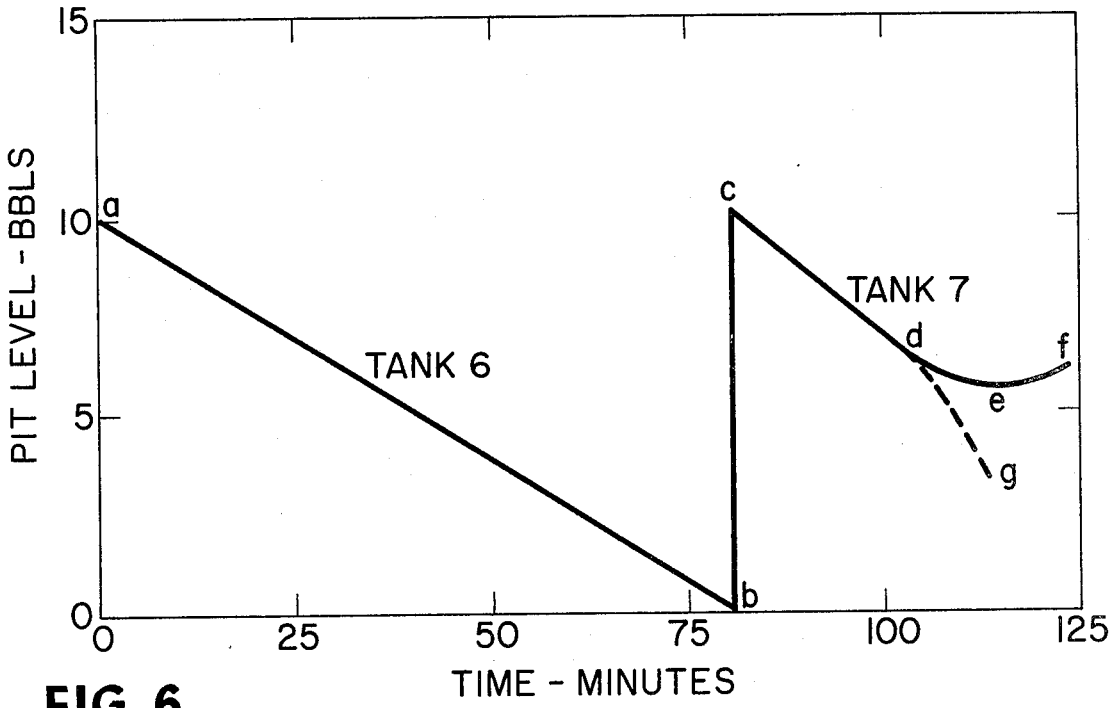
FIG. 6 is a graph plotting the rate of monitoring tank level drop versus time for a monitoring section as shown in FIG. 2 illustrating performance under abnormal condition.

FIGS. 5 and 6 presents plots of performance curves recorded by recorder 61. Assuming the working volume in each monitoring tank is 10 barrels, the slope from a to b illustrates tank 6 emptying. Note that this rate is equal to the volume of material being discarded in the solids removal section under normal conditions. If no material were being discarded, the slope of the curve a-b would be horizontal. Beginning at point c, the same normal conditions show the emptying of tank 7. Both lines a–b and c–d are constant slopes indicating normal circulation. In FIG. 6, again the slope between a and b represents a normal operation with a constant rate of decline of the level in tank 6. In tank 7, the slope of line c–d indicates normal operation; however, between d and e there is a change—in this case, a decrease in the rate of volume change of fluid in tank 7 indicating an increase in mud volume in the drilling system. This increase can only come from an influx of fluid from a formation. As indicated by the upward slope of the curve between e and f, the mud volume is increasing, providing a positive indication of a kick. (If lost circulation were encountered, the curve would slope downward as indicated by portion d–g.) In practice, when the slope begins changing at d, the operator will be on the alert of pending trouble. If the slope continues to level off and increase as between e and f, preventive measures must be taken to avoid a blowout.

FIG. 3 is a top view, shown in schematic, illustrating a portion of the solids removal section and the preferred monitoring section. The components of solids removal section may be the same as described for the embodiment described in FIG. 2 and, therefore, has been given the same designations as in FIG. 2. In this embodiment, only one monitoring tank 116 is employed; this tank replaces the two suction tanks 6 and 7 of the embodiment illustrated in FIG. 2.

As best seen in FIG. 4, mud from tank 5 (FIG. 3) enters the monitoring tank 116 via line 110 and exits tank 116 via line 115 returning to the well through the mud pumps (not shown).

A constant level is maintained within monitoring tank 116 by means of level control devices and feed pump arrangement. A line 127 interconnects reserve tank 8 and monitoring tank 116 and is provided with pump 121, meter 126*a*, and control valve 113. A loop 128 (not shown in FIG. 3), also provided with a control valve, bypasses pump 121 and control valve 113. A level controller 111, connected to a suitable electrical or pneumatic source 112*a*, sends a signal via line 112 to a valve controller 118 proportional to the mud level within tank 116. Float 117 may be employed to detect level within tank 116. Controller 118, in turn, sends a signal to control valve 113 via line 119. This signal may also be sent to instrument panel 126 for recordation or alarm actuation. High level switch 122 and low level switch 123 are also provided.

In operation the level control devices 111 and 118 are adjusted to provide a constant control level 120 within tank 116. This positions the valve 113 to pass sufficient mud from tank 8 into tank 116 to offset the loss of mud volume resulting from materials discard in the solids removal section of the system; in terms of flow balance $Q_2=Q_4$. The meter 126 or the position of valve 113 (or the signal from controller 118) provides an indication of the rate of mud addition to maintain the constant mud volume in the system. Under a given set of drilling and mud treating conditions, this rate should be relatively constant. Under normal operating conditions, the total volume of the mud system will be maintained within 5 barrels and preferably 2 barrels of a predetermined volume. If an abnormal drilling condition is encountered, such as the influx of formation fluid, the total volume of the mud system will be changed (i.e., $Q_2 \neq Q_4$). In the case of a kick, the volume will be increased. Since the tanks 1–5 provide a substantially constant volume, the increase will be indicated by an increase of mud level 120 in monitoring tank 116. The increased level will be promptly detected by level control device 111, through the action of valve controller 118, will cause valve 113 to reduce the flow of makeup mud to tank 116.

The change in the flow rate through line 127 will be recorded either by meter 126 or by the change in the control signal to valve 113. Also, devices indicating the position of valve 113 may be used to indicate flow through line 127. This change in flow provides an initial indication of an abnormal drilling condition. If the condition (i.e., kick) increases to the extent that $Q_f$ exceeds $Q_2$, the valve 113 will close completely and the level 120 will rise and activate high level switch 122 which will actuate an alarm. Switch 122 may also actuate controls to open valve 128*a* to permit mud flow from tank 116 to reserve tank 8.

If lost circulation is encountered, the mud volume will be reduced, causing the level 120 within tank 116 to drop. This condition will cause valve 113 to open which increases the mud flow from reserve tank 8 to tank 116. The change in flow, recorded by the instrument 126, will provide an early indication of lost returns. If the rate of mud lost to the formation in addition to solids rate discarded exceeds the rate at which makeup mud is added through lines 127, the mud level within tank 116 will drop and actuate switch 123. This will set off an alarm and, if desired, may be connected to open valve 128*a*. Opening of valve 128 will permit mud to flow from tank 8 to tank 116, assuming that the mud level in tank 8 is higher than the mud level in tank 116.

The size of tank 116 and location of the switches 122 and 123 will depend on several factors and may vary within a wide range. However, the diameter of tank 116 should be relatively small (in the order of 5 to 7 feet) to make the system sensitive to small changes in mud volume. Level switches should be within 12 inches of the controlled level 120 to provide actuation for changes of not more than about seven barrels. Also, a wide variety of level controls and valving arrangements to provide the flow of makeup mud from tank 8 to tank 116 may be used. It's important, however, that the flow be responsive to changes in the mud level within tank 116 and that it provide sufficient flow to compensate for the volume rate of material discarded.

As will be apparent to those skilled in the drilling from the above description, the present invention provides a highly sensitive and reliable technique for detecting an abnormal drilling condition.

What is claimed is:

1. In a method of drilling a well through earth formations wherein mud is circulated in a mud system from the surface through a drill string in the well and back to the surface, the improvement which comprises:

(a) removing material including drilled solids from the mud system at the surface;

(b) adding makeup mud to the mud system responsive to and at substantially the same rate as the material being removed to maintain a substantially constant volume in the mud system under normal circulating conditions; and (c) monitoring the rate of makeup mud added to the system to detect an abnormal circulating condition.

2. A method as defined in claim 1 wherein the monitoring step comprises determining the normal rate of addition of makeup mud, and monitoring said rate, a departure from said normal rate providing an indication of an abnormal circulation condition.

3. In a method of drilling a well through subterranean formations wherein a mud is circulated in a mud system from the surface through a drill string and back to the surface, the improvement comprising:

(a) passing the mud through a solids removal section at the surface wherein material including drilled solids is removed from the mud, said solids removal section having a plurality of tanks, the mud levels in said tanks of said solids removal section being maintained substantially equal, (b) passing the mud from said solids removal section into a monitoring tank, (c) adding makeup fluid to the monitoring tank at substantially the same rate material is removed in the solids removal section to maintain a substantially constant level in said monitoring tank under normal circulating conditions, (d) monitoring the level of mud in said monitoring tank to detect an increase thereof by an amount indicative of an influx of fluid from a subterranean formation, and (e) passing the mud from said monitoring tank into said well.

4. A method of drilling a well which comprises:

(a) circulating mud from the surface through earth formations and back to the surface, (b) removing material including drilled solids from the mud, (c) adding makeup fluid to the mud to maintain a substantially constant mud volume at the surface under normal circulating conditions, (d) determining the rate of makeup fluid added to the mud under normal circulating conditions, and (e) monitoring the addition of makeup fluid, a rate of addition different than the normal rate determined in step (d) providing an indication of an abnormal circulating condition.

5. A method for detecting abnormal conditions during the drilling of a well through subterranean formations wherein mud is circulated in a mud system from the surface through a drill string and back to the surface comprising:

(a) removing material including drilled solids from said mud system in a solids removal section, and (b) passing said mud from said solids removal section into a monitoring section wherein the rate change of the volume of the mud system is determined by flowing a mud makeup stream into said monitoring section at substantially the same rate as material is removed from the mud system under normal circulating conditions, and controlling the rate of flow of said mud makeup stream to maintain a substantially constant mud volume in said mud system, said rate of flow being constant within a predetermined range under normal conditions in said well during drilling, wherein an increase in the flow rate indicates a loss of fluid from said well to a subterranean formation and a decrease in the flow rate indicates an influx of fluid from a subterranean formation into said well.

6. A method of monitoring mud in a system being circulated in a well which comprises:

(a) flowing mud from said well into a solids removal section, (b) removing material including drilled solids from the mud in said solids removal section, (c) maintaining the mud in said solids removal section within two barrels of a predetermined volume, (d) flowing mud from said solids removal section into a monitoring tank, (e) maintaining the volume of mud in said monitoring tank substantially constant under normal circulating conditions by adding makeup fluid thereto at substantially the same rate as material is removed in step (b), and (f) monitoring the volume of mud in said monitoring tank to detect changes in the mud volume therein by a predetermined amount thereby indicating an abnormal circulating condition.

7. A method for circulating mud from surface facilities through a well being drilled through earth formations, said method comprising:

(a) flowing mud from said well into a solids removal section of said surface facilities;

(b) removing material from said mud in said solids removal section;

(c) passing mud from said solids removal section into a monitoring section of said surface facilities;

(d) adding makeup fluid in response to the level changes in said monitoring section to maintain an operating mud volume in said sections within five barrels of a predetermined volume under normal circulating conditions;

(e) flowing mud from said monitoring section to said well; and (f) monitoring the fluid level in said monitoring section to detect a mud volume outside said operating volume, thereby indicating an abnormal circulating condition.

8. A mud system for receiving and treating mud being circulated in a well which comprises:

(a) a plurality of tanks for receiving mud from said well, (b) means for removing material including drilled solids from the mud, (c) means for maintaining the mud volume in said tanks substantially constant, said means including means to introduce makeup fluid into the mud at about the same rate as material being removed therefrom under normal circulating conditions, and (d) means for determining when the rate of makeup fluid being added differs from the rate of material being removed, said means being operative to indicate an abnormal circulating condition.

9. A mud system for receiving and treating mud being circulated in a well which comprises:

(a) a solids removal section including a plurality of tanks and means for removing material including drilled solids from the mud, (b) means for maintaining the fluid levels in said tanks substantially the same, (c) a monitoring tank adapted to receive mud from said tanks of the solids removal section, said monitoring tank including liquid level control means for monitoring the level of mud in said monitoring tank, and (d) means responsive to said liquid level control means for adding makeup fluid to the system to maintain the mud volume thereof substantially constant under normal circulating conditions.

10. The system as defined in claim 9 wherein each tank of the solids removal section includes a mud containing body and a riser portion of reduced cross section, and wherein the means for maintaining the fluid levels in said tanks is operative to maintain the level of mud in each tank in the riser portion thereof.

11. The system as defined in claim 10 wherein said riser portions of said tanks provide a total mud/air interface of not more than 1000 square inches.

12. Apparatus for monitoring fluid circulation in a mud system having pump means to circulate a drilling fluid from a well through a solids removal section and back to said well comprising:

(a) a monitoring tank in fluid communication with said solids removal section, (b) a reserve tank, (c) a conduit interconnecting said reserve tank and said monitoring tank.

(d) pump means to deliver fluid from said reserve tank to said monitoring tank, (e) level detecting means mounted in said monitoring tank to detect a predetermined control level therein and variations therefrom, and (f) a control valve mounted in said conduit and being operatively responsive to said level detection means to open and increase the fluid flow rate in response to a fluid level in said monitoring tank falling below the control level and to close and reduce the fluid flow rate in response to a fluid level rising above said control level whereby the volume of mud in said mud system is maintained within a predetermined operating range.

13. The mud system as defined in claim 1 wherein the predetermined range is within the five barrels of the mud volume at said control level.

14. A method of detecting an influx of formation fluids during the drilling of a well through earth formations wherein mud is circulated in a mud system from the surface through a drill string and back to the surface, said method comprising:

(a) removing material including drilled solids from the mud system in a solids removal section;

(b) maintaining the volume of mud in the solids removal section substantially constant;

(c) passing the mud from the solids removal section into a monitoring tank;

(d) adding makeup fluid to the mud system at a rate substantially equal to the rate of material removal minus the rate of influx of formation fluid into the mud system; and (e) monitoring the volume of mud in the monitoring tank, an increase thereof indicating a rate of influx of formation fluid in excess of the rate of material removal.

15. A method as defined in claim 14 wherein the monitoring step includes actuating an alarm when the level of mud in the monitoring tank reaches a predetermined level, said level being less than about seven barrels greater than the normal operating level of said monitoring tank.

16. A mud system for receiving and treating mud being circulated in a well which comprises:

(a) a solids removal section including a plurality of tanks and means for removing material including drilled solids from the mud;

(b) a monitoring section including (i) two monitoring tanks connected in parallel, (ii) means for alternating the operation of each tank whereby the mud from the solids removal section is received alternately in said monitoring tanks, and (iii) liquid level sensing means for monitoring the level of mud in each monitoring tank, and (iv) means for determining the rate of change of level in each tank.

17. A mud system for receiving and treating mud being circulated in a well which comprises:

(a) a solids removal section including plurality of tanks, each of said tanks including a mud containing body and a riser portion of reduced cross section, said tanks being in fluid communication with each other; and (b) means for maintaining the level of mud in each tank in the riser portion thereof; said riser portion and said level maintaining means be sized to maintain the total mud volume of said tanker within two barrels of a predetermined volume.

18. The system as defined in claim 17 wherein the riser portions of said tanks has a combined cross sectional area of less than 1000 square inches.

19. The mud system as defined in claim 17 wherein the level maintaining means and riser portions are sized to maintain the total mud volume in the solids removal section within one barrel of a predetermined volume.

20. A mud system which comprises:

(a) a solids removal section including means for removing material therefrom and a plurality of tanks;

(b) means for maintaining the volume of mud in said tanks constant within two barrels of a predetermined volume;

(c) a monitoring tank adapted to receive mud from said solids removal section;

(d) a reserve tank adapted to contain mud makeup fluid;

(e) liquid level control means mounted in said monitoring tank;

(f) flow control means interconnecting said reserve tank and said monitoring tank for adding makeup fluid to said monitoring tank in response to said liquid level control means for maintaining a predetermined operating liquid level range therein under normal drilling conditions, said means for maintaining the volume of mud in said tanks and said flow control means being operative to maintain the volume of the mud system within five barrels of a predetermined volume under normal circulating conditions.

21. The mud system as defined in claim 20 and further comprising means for monitoring the rate of addition of makeup fluid for determining the rate of the addition of makeup fluid under normal circulating conditions and for determining.

22. The mud system as defined in claim 20 and further comprising a means for detecting an increase of mud volume in said monitoring tank by predetermined amount sufficient to indicate the influx of formation fluid but less than about seven barrels.

23. A method for detecting abnormal conditions during the drilling of a well through subterranean formations comprising:

(a) circulating a mud through a wellbore during drilling, (b) removing material including drilled solids from said mud in a solids removal section, (c) passing said mud from said solids removal section into a monitoring section, (d) maintaining the mud in the monitoring section at substantially a constant volume by adding makeup fluid thereto at about the same rate as material is removed in step (b), the rate of makeup fluid addition providing an indication of rate of mud volume change, and (e) circulating said fluid from the monitoring section back to said well.

* * * * *